United States Patent [19]

Kugisawa

[11] 4,141,268

[45] Feb. 27, 1979

[54] KEYBOARD APPARATUS FOR AN ELECTRONIC MUSICAL INSTRUMENT

[75] Inventor: Toshio Kugisawa, Hamamatsu, Japan

[73] Assignee: Kabushiki Kaisha Kawai Gakki Seisakusho, Hamamatsu, Japan

[21] Appl. No.: 811,639

[22] Filed: Jun. 30, 1977

[30] Foreign Application Priority Data

Jul. 2, 1976 [JP] Japan ..... 51-78647

[51] Int. Cl.[2] ..... G10H 1/00

[52] U.S. Cl. ..... 84/1.03; 84/1.01; 84/1.24; 84/DIG. 2

[58] Field of Search ..... 84/1.01, 1.03, 1.24, 84/DIG. 2, DIG. 7, DIG. 23; 340/365 R, 365 S

[56] References Cited

U.S. PATENT DOCUMENTS

| | | | |
|---|---|---|---|
| 3,986,423 | 10/1976 | Rossum | 84/1.01 |
| 4,022,098 | 5/1977 | Deutsch | 84/1.01 |
| 4,074,233 | 2/1978 | Swain | 84/1.01 |

*Primary Examiner*—Robert K. Schaefer

*Assistant Examiner*—Leonard W. Pojunas, Jr.

[57] ABSTRACT

Keyboard apparatus for an electronic musical instrument in which a particular code is assigned to each of keys of the keyboard and which is provided with a multiplexer circuit for detecting the depression of the key corresponding to an input code, means for sequentially generating the codes of the keys, memory means for storing the codes, a comparator circuit for comparing the outputs from the memory means and the code generating means to provide a coincidence signal when the both outputs are coincident with each other, a cycle control circuit for controlling a key ON cycle and a key OFF cycle in distinction from each other, and gate means for selecting the output code from the code generating means and the code of the memory means with the key ON cycle and the key OFF cycle to output to the multiplexer circuit. In the key ON cycle, the multiplexer circuit detects that the key having not been depressed yet is newly depressed, and stores it in the memory means. In the key OFF cycle, the multiplexer circuit detects that the key already depressed is newly released, and erases the content of the memory means.

9 Claims, 14 Drawing Figures

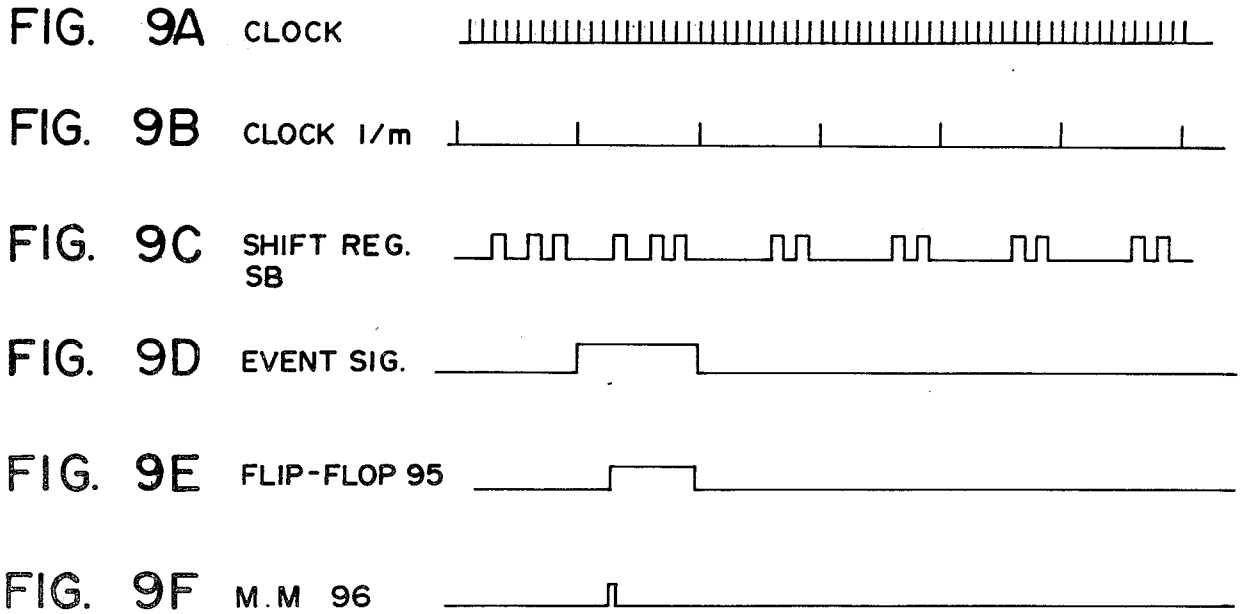
FIG. 9A CLOCK
FIG. 9B CLOCK 1/m
FIG. 9C SHIFT REG. SB
FIG. 9D EVENT SIG.
FIG. 9E FLIP-FLOP 95
FIG. 9F M.M 96

KEYBOARD APPARATUS FOR AN ELECTRONIC MUSICAL INSTRUMENT

BACKGROUND OF THE INVENTION

1. Field of the Invention

This invention relates to a keyboard apparatus for an electronic musical instrument which performs digital processing.

2. Description of the Prior Art

A method that has heretofore been employed to detect the depressed or released state of each of the keys on the keyboard is to sequentially scan the keys from a low-pitched to a high-pitch sound range or vice versa, thereby to detect the key depressed state in the form of a time-division multiplexed signal, as set forth, for example, in U.S. Pat. No. 3,610,799 entitled "Multiplexing System for Selection of Notes and Voices in an Electronic Musical Instrument." Registers are provided for extracting and storing signals representing the octave and the name of a sound of the depressed key from the time-division multiplexed signal. The number of such registers are generally limited by a maximum number of keys depressed to a dozen or so. Since writing in the registers is achieved with the abovesaid time-division multiplexed signal, even if the signals of the octave and sound name of the depressed key are already written in one of the registers, the time-division multiplexed signal is repeated and the signal corresponding to the abovesaid key is included therein. Then, it is necessary to effect a control so that the same content as that of the register having already written therein may not be written.

Further, when the key is released, only the key depressed signal is removed, so that it is necessary to extract the signals of the octave and sound name of the key for which the depressed signal has disappeared, to search for the register having written therein the same content as the abovesaid signals and to erase the content of the register or apply it as a fall start signal to an envelope control circuit corresponding to the register.

SUMMARY OF THE INVENTION

This invention has for its object to provide a keyboard apparatus for an electronic musical instrument which is capable of controlling the key depression and release in clear distinction from each other.

Briefly stated, according to this invention, there is provided a keyboard apparatus for an electronic musical instrument in which a particular code is assigned to each of the keys of the keyboard and which is provided with a multiplexer circuit for detecting the depression of the key corresponding to an input code, means for sequentially generating the codes of the keys, memory means for storing the codes, a comparator circuit for comparing the outputs from the memory means and the code generating means to provide a coincidence signal when the both outputs are coincident with each other, a cycle control circuit for controlling a key ON cycle and a key OFF cycle in distinction from each other, and gate means for selecting the output code from the code generating means and the code of the memory means with the key ON cycle and the key OFF cycle to output to the multiplexer circuit. In the key ON cycle, the multiplexer circuit detects that the key having not been depressed yet is newly depressed, and stores it in the memory means. In the key OFF cycle, the multiplexer circuit detects that the key already depressed is newly released, and erases the content of the memory means.

BRIEF DESCRIPTION OF THE DRAWINGS

FIGS. 9A to 9F are timing charts explanatory of one part of the operation of a select circuit used in FIG. 8.

DESCRIPTION OF THE PREFERRED EMBODIMENTS

With reference to the drawings, the present invention will hereinafter be described in detail.

Figure 1:
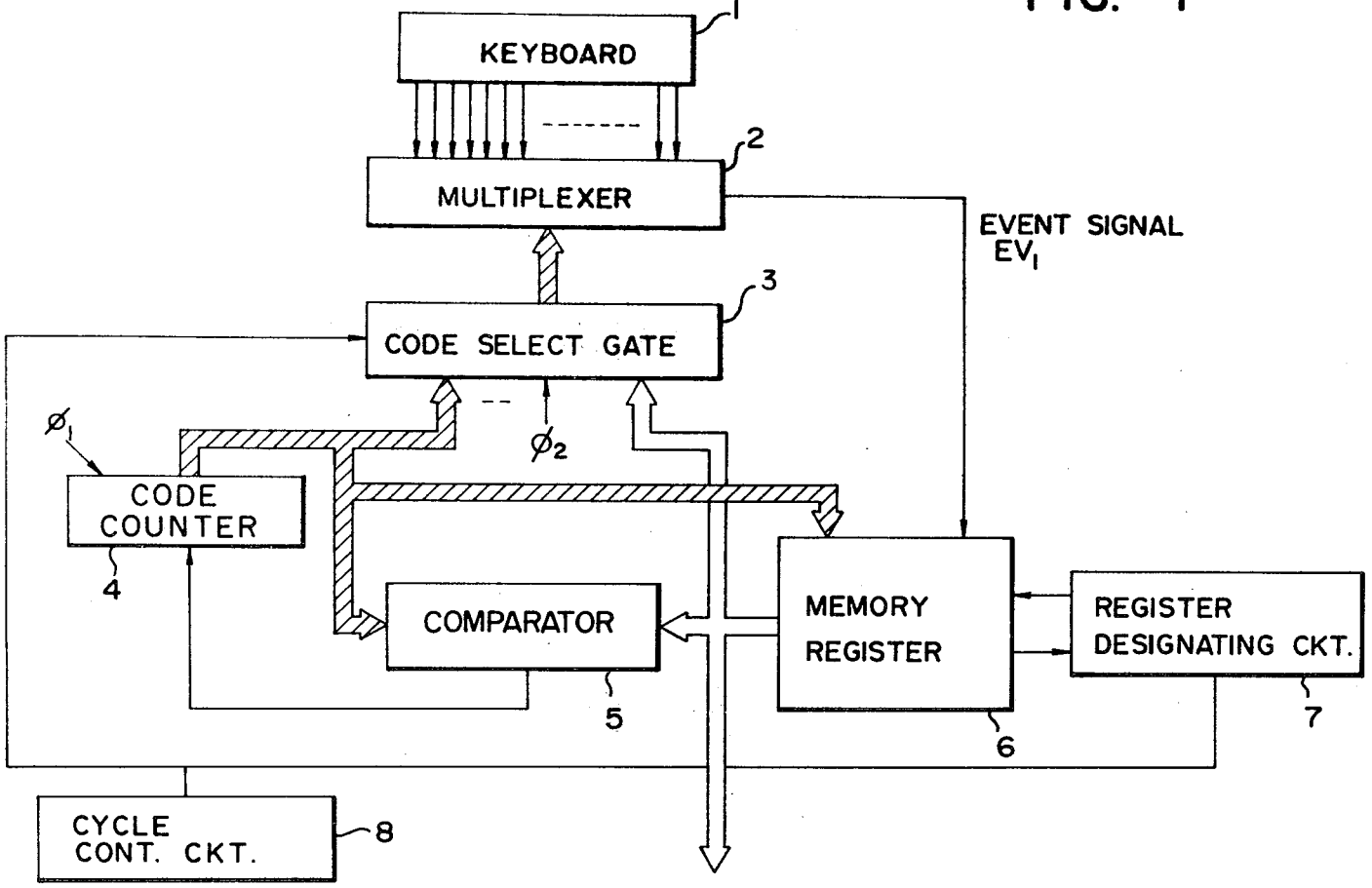
FIG. 1 is a block diagram illustrating the construction of an embodiment of this invention.

FIG. 1 is a block diagram illustrating an embodiment of this invention. In FIG. 1, reference numeral 1 indicates a keyboard; 2 designates a multiplexer circuit; 3 identifies a code select gate; 4 denotes a code counter; 5 represents a comparator circuit; 6 shows a memory register; 7 refers to a register designating circuit; and 8 indicates a cycle control circuit. The cycle control circuit 8 distinguishes between a key ON cycle and a key OFF cycle and, in the key on cycle, the code select gate 3 selects with a cycle control signal a binary code which is derived from the code counter 4. That is, two kinds of timing $\phi_1$ and $\phi_2$ are employed, and the code select gate 3 provides a code selected only in the period of the timing $\phi_2$ and applies it to the multiplexer circuit 2. Keys of the keyboard 1 each correspond to the binary code which is generated by the code counter 4. The multiplexer circuit 2 detects depression of the key corresponding to the binary code and, in the key ON cycle, produces an event signal $EV_1$ if the key is in the depressed position. In the period of the timing $\phi_2$, the binary code is stored by the event signal $EV_1$ at an idel address of the memory register 6.

In the period of the timing $\phi_1$, the binary code in the code counter 4 is applied to the comparator 5 for comparison with the binary code stored at each address of the memory register 6. In the case of noncoincidence, that is, where the code stored in the memory register 6 and the code in the code counter 4 are noncoincident with each other, and more in concrete terms, when the binary code of the key put in its depressed position is not coincident with the code of the code counter 4, the timing $\phi_1$ is switched to $\phi_2$. The depressed state of the key corresponding to the abovesaid binary code in the code counter 4 is checked through the code select gate 3 and the multiplexer circuit 2 and if the abovesaid key is in the depressed state, the binary code is stored in the memory register 6. Then, the timing $\phi_2$ shifts to $\phi_1$ again and the code counter 4 provides the next binary code.

In the case of coincidence, that is, where the binary code stored in the memory register 6 and the binary code in the code counter 4 are coincident with each other, and more in concrete terms, when the binary code of the key already depressed and the binary code of the code counter 4 are coincident with each other, an incremental signal In, which is produced in the case of coincidence in the comparator 5, is provided in the period of the timing $\phi_1$ and applied to the code counter 4 to derive therefrom the next binary counter. Accordingly, the timing $\phi_2$ does not exist for the code of the key in the depressed state and key depression is not checked by the multiplexer circuit 2. When the abovesaid operation has thus been performed for all of the keys on the keyboard, the code counter 4 temporarily stops and the next key OFF cycle is provided.

In the key OFF cycle, the code select gate 3 selects a binary code from the memory register 6 with the cycle control signal and, only in the period of the timing $\phi_2$, applies the binary code to the multiplexer circuit 2. The multiplexer circuit 2 detects the depression of that one of the keys of the keyboard 1 which corresponds to the abovesaid binary code, and produces an event signal $EV_2$ when the key is not in its depressed but lifted position in the key OFF cycle. The event signal $EV_2$ clears the content of the address in which the abovesaid binary code is to be stored. Where the key is in its depressed position, since no event signal $EV_2$ is produced, the code of the key in the memory register 6 is not altered. In the key OFF cycle, one address in the memory register 6 is read out during the period of the timing $\phi_1$ and if a code is stored in the address, the timing $\phi_1$ is altered to $\phi_2$, applying the code to the code select gate 3. Where no code is stored in the address (all bits being 0), it is detected in the period of the timing $\phi_1$ and the operation shifts to the period of the timing $\phi_1$ during which the content of the next address is detected. That is, in this case, an idle address is detected and the stage of the timing $\phi_2$ does not exist for this idle address.

Figure 2:
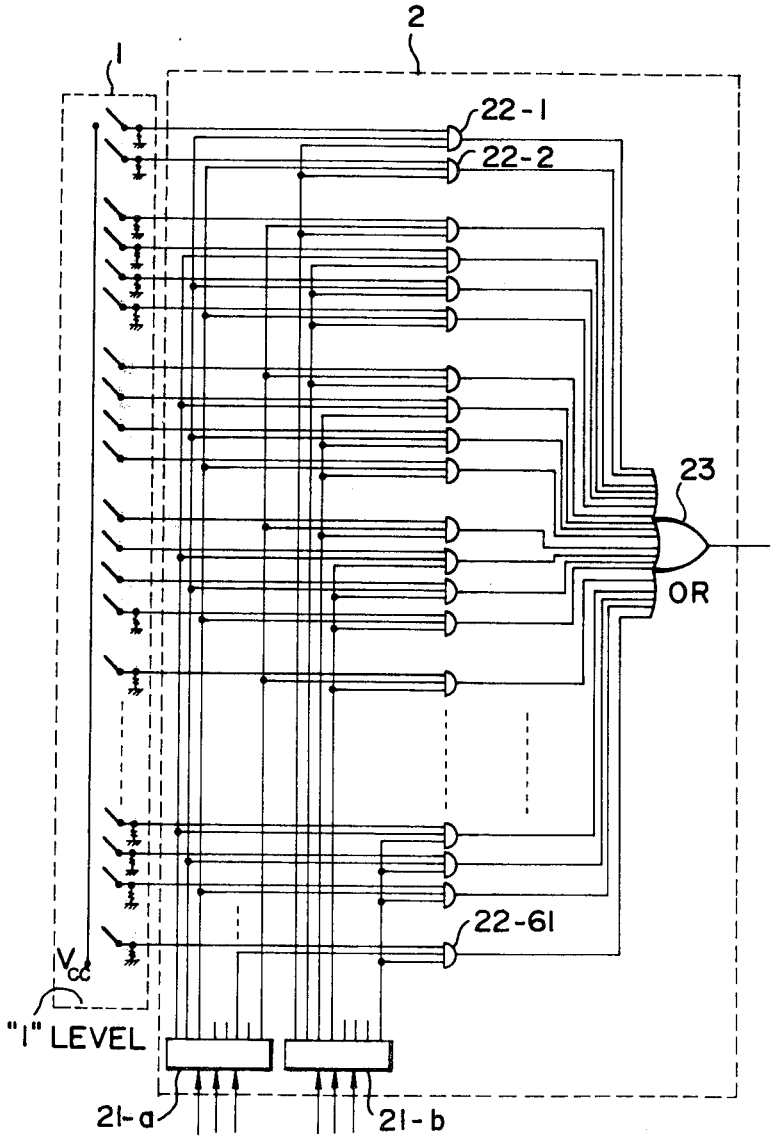
FIG. 2 is a detailed explanatory diagram showing a keyboard and a multiplexer circuit depiicted in FIG. 1.

FIG. 2 shows in detail the keyboard 1 and the multiplexer circuit 2 employed in the embodiment of FIG. 1. In this instance, the keyboard 1 is shown to have sixty-one keys. Since the number of keys is sixty-one, the number of bits of the binary code used is six and codes "000001" to "111101" respectively correspond to the keys. Reference numerals 21-*a* and 21-*b* indicate decoders. The 6-bit binary code supplied to the decoders from the code select gate 3 is divided into two; three higher-order bits and three lower-order bits, and the decoders each apply a signal "1" to one of their eight output lines. Depending upon the combination of the eight output lines from each of the decoders 21-*a* and 21-*b*, one of AND gates 22-1 to 22-61 is opened. In this case, if the key designated by the 6-bit binary code is in its depressed position, an OR gate 23 provides a signal of the level "1" and, if not a signal of the level "0."

Figure 3:
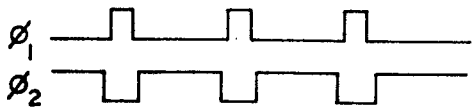
FIG. 3 shows operation cycle timing $\phi_1$ and $\phi_2$ of the circuit depicted in FIG. 1.

FIG. 3 is a diagram of the operation cycle timing showing the relationship between the timing $\phi_1$ and $\phi_2$, which are alternate with each other as illustrated.

Figure 4:
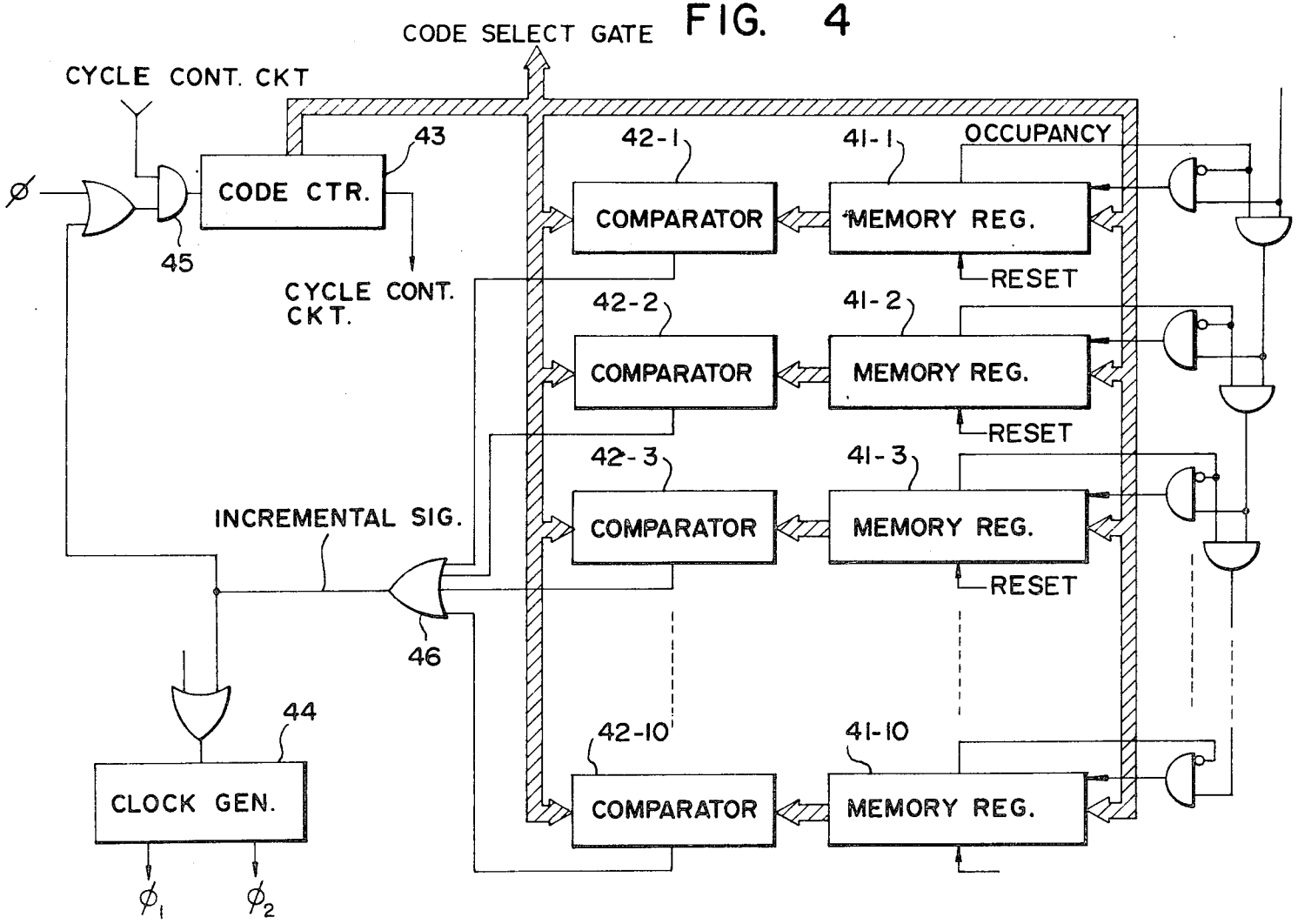
FIG. 4 is an explanatory diagram showing parts relating to the operation in the key ON cycle in the embodiment of FIG. 1.

FIG. 4 illustrates in detail the parts relating to the operation in the key ON cycle in the embodiment of FIG. 1. Reference numerals 41-1 to 41-10 indicate memory registers; 42-1 to 42-10 designate comparator circuits; 43 identifies a code counter; and 44 denotes a timing clock generator. The reason for the provision of ten memory registers is that ten priority channels are employed. In the key on cycle, a clock pulse $\phi_1$ is applied through an AND gate 45 to the code counter 43 to increase its count value (output code) one by one, which is applied to the comparator 42 and the memory register 41. Since coincidence of the code in the memory register 41 with the code from the code counter 43 implies that the key corresponding to the code of the code counter 43 has already been depressed and that its code has been stored in the memory register 41, there is no need of checking the depression of the key by the multiplexer circuit 2. Then, a coincidence signal from the comparator circuit 42 is applied as an incremental signal to the clock generator 44 and the code counter 43 through an OR gate 46. Upon reception of the coincidence signal, the clock generator 44 generates the clock pulse $\phi_1$ to increase the count value of the code counter 43 by one, deriving therefrom the next code.

Further, since noncoincidence of the code in the first memory register 41 with the code from the code counter 43 indicates that the key corresponding to the latter code has not been depressed, there is a need of checking whether it is in the depressed position or not at this moment. In this case, no incremental signal is produced and the operation shifts to the timing $\phi_2$, with the codes held unchanged. In the period of the timing $\phi_2$, the code from the code counter 43 is applied to the multiplexer circuit 2 through the code select gate 3 shown in FIG. 1. If the key corresponding to this code has been depressed, the event signal $EV_1$ is generated from the multiplexer circuit 2, by which the abovesaid code is written in the first memory register 41, as described previously in connection with FIG. 1. The memory registers 41-1 to 41-10 have priority levels in this order, and the aforesaid code is written in an idle one of the memory registers.

Figure 5:
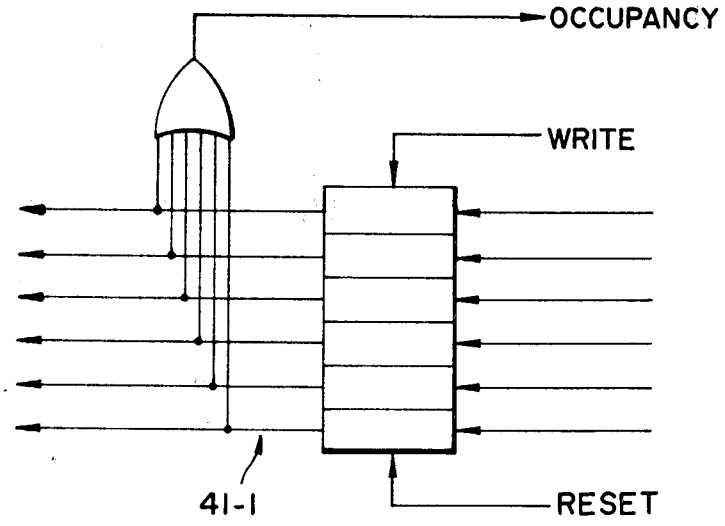
FIG. 5 is a circuit diagram illustrating an example of memory registers used in FIG. 4.

FIG. 5 is a schematic representation of one example of the memory register 41. In FIG. 5, since there is not provided a key whose bits all correspond to "0," a code "000000" is representative of non-occupancy and the OR gate output signal becomes a "busy" signal. Resetting of the memory register 41 takes place in the key OFF cycle.

Figure 6:
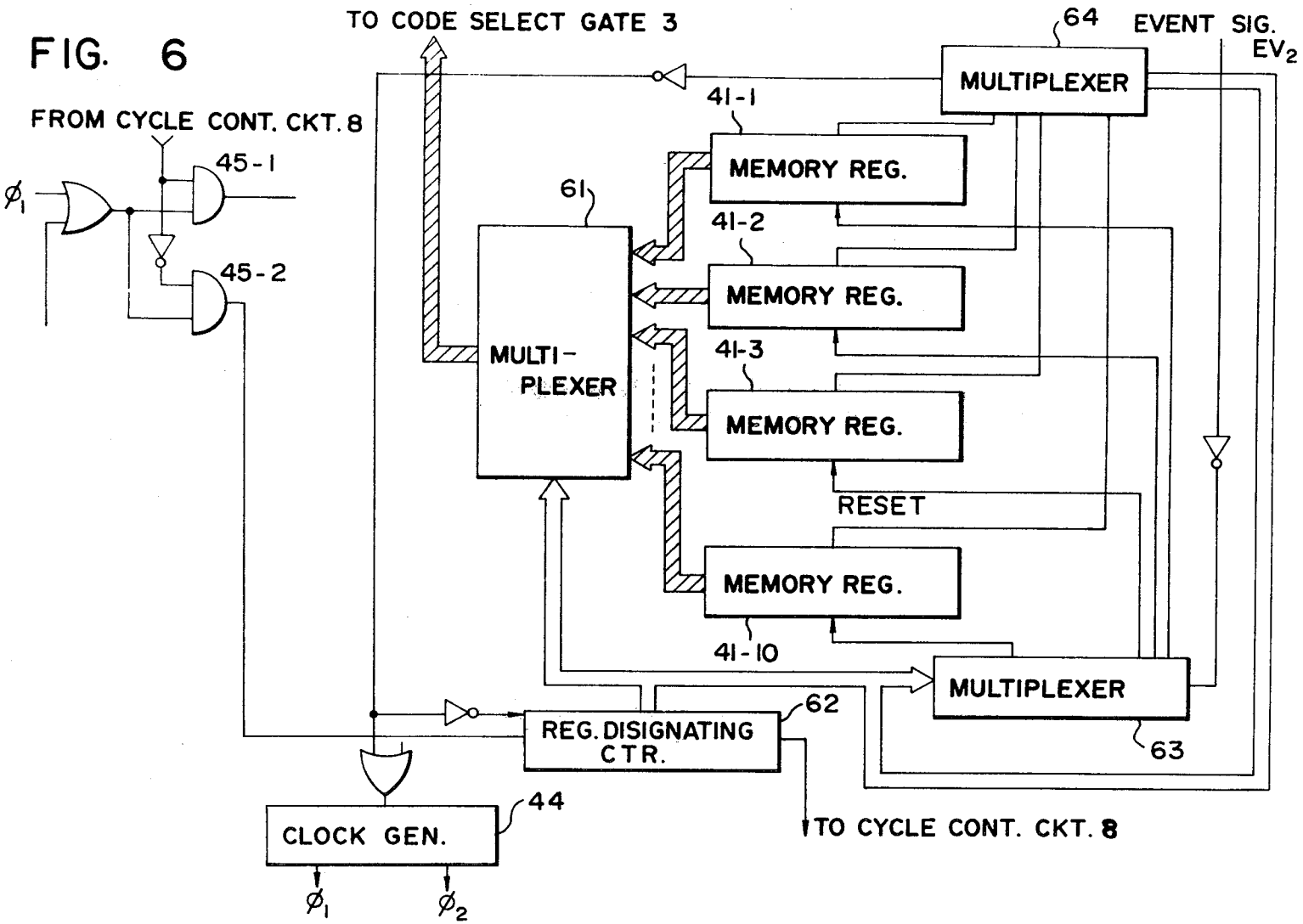
FIG. 6 is an explanatory diagram showing parts relating to the operation in the key OFF cycle in the embodiment of FIG. 1.

FIG. 6 illustrates in detail the parts relating to the operation in the key OFF cycle in the embodiment of FIG. 1. Reference numerals 61, 63 and 64 indicate multiplexer circuits and 62 designates a register designating counter. With a signal from an AND gate 45-2, the register designating counter 62 designates the memory register 41-1 to check whether or not it has written therein a code in the period of the timing $\phi_1$. Where the memory register 41-1 has already stored therein a code, the period of the timing $\phi_2$ is initiated and the code from the memory register 41-1 is applied to the code select gate 3 and the multiplexer circuit 2 through the multiplexer circuit 61 to check the state of the key corresponding to the code. If the key is held in its depressed position, no event signal is generated and, if not, the event signal $EV_2$ is applied through the multiplexer circuit 63 to the memory register 41-1 to reset it and hence erase its content. Then, the timing $\phi_2$ shifts to $\phi_1$ and the register designating counter 62 designates the memory register 41-2.

Where the memory register 41-1 has not stored therein any code, an "idle" signal is applied from the multiplexer circuit 64 to the clock generator 44 and the register designating counter 62, with the result that the clock generator 44 generates again the clock pulse $\phi_1$ to increase the count value of the register designating counter 62 by one, designating the memory register 41-2. Thereafter, the memory registers 41-3 to 41-10 are similarly designated one after another. When all the memory registers have thus been designated, a key OFF cycle end signal is applied from the register designating counter 62 to the cycle control circuit 8.

In this manner, the key ON cycle and the key OFF cycle repeatedly take place alternately with each other to detect the key depression.

When the memory registers 41-1 to 41-10 are all used, a new key depression need not be checked and the key OFF cycle is repeated.

Figure 7:
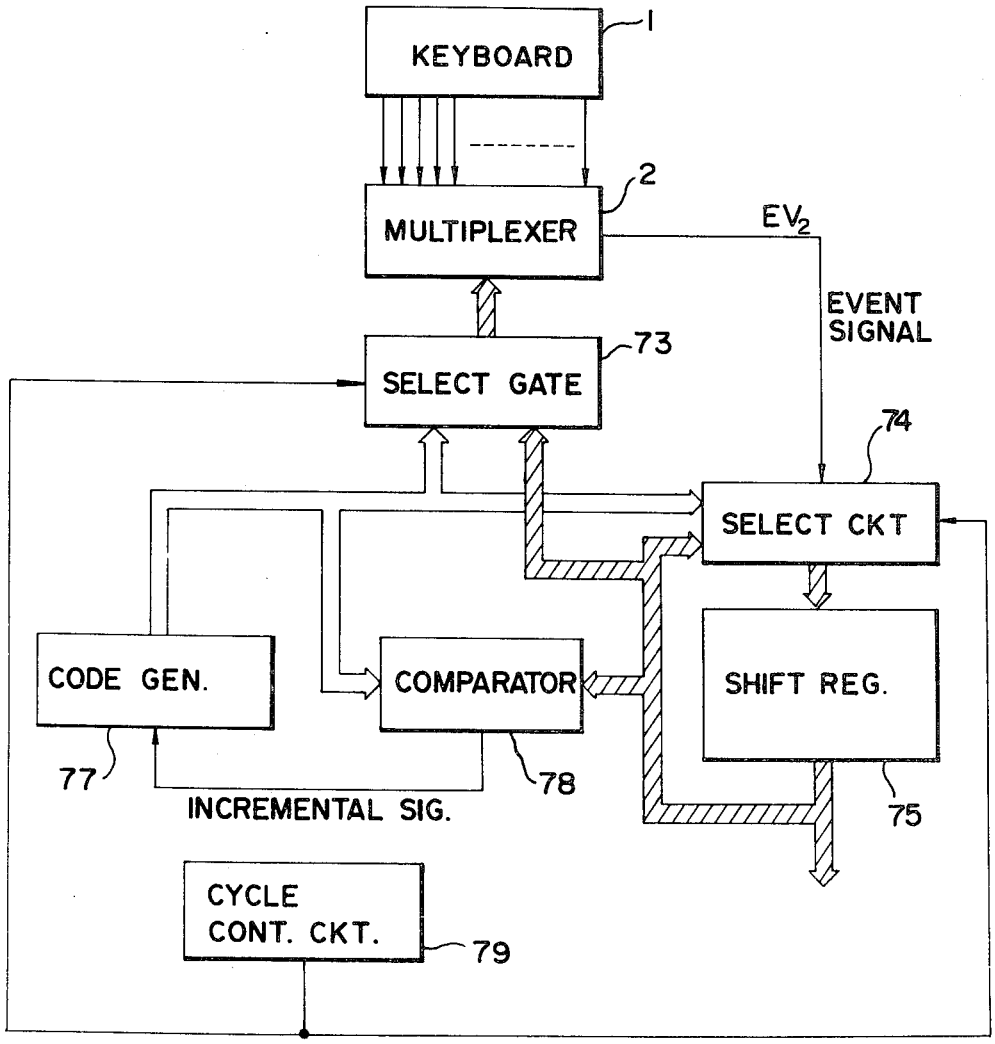
FIG. 7 is a block diagram illustrating another embodiment of this invention.

FIG. 7 shows another embodiment of this invention. In FIG. 7, reference numeral 1 indicates a keyboard and 2 designates a multiplexer circuit, which are respectively identical with those employed in the embodiment of FIG. 1. Reference numeral 73 identifies a select gate; 74 denotes a select circuit; 75 represents a shift register; 77 shows a code generator circuit; and 78 refers to a comparator circuit. The binary codes, which are generated by the code generator 77, respectively correspond to the keys of the keyboard 1. For example, if the number of keys is sixty-one, the binary code is composed of six bits. For a depressed key, this code is stored in the shift register 75. The operation of the present circuit is divided into the key ON cycle and the key OFF cycle. In the key ON cycle, the code generated by the code generator 77 is supplied to the multiplexer circuit 2 through the select gate 73. The multiplexer circuit 2 checks whether the key corresponding to the code is in its depressed position or not, and if the key is in the depressed state, the event signal $EV_2$ is applied from the multiplexer circuit 2 to the select circuit 74. Further, the code generated by the code generator 77 is also applied to the select circuit 74, which writes the abovesaid code in the shift register 75 in response to the event signal $EV_2$. Where the key is not depressed, the event signal $EV_2$ is not produced and no code is written in the shift register 75.

The code corresponding to the key already depressed is stored in the shift register 75, which circulates through the select circuit 74 each time the output code from the code generator 77 changes. The output from the shift register 75 is applied to the comparator circuit 78 and compared with the code from the code generator 77. If the both codes are coincident with each other, a coincidence signal is applied as an incremental signal to the code generator 77 to switch its output code to the next one. The key scanning by the code in the case of coincidence is not effected.

In the key OFF cycle, the code generator 77 stops and, based on a control signal from the cycle control circuit 79, the select gate 73 applies the code from the shift register 75 to the multiplexer circuit 2. In the key OFF cycle, since the code of the depressed key is already stored, key scanning is performed for this depressed key only. Where the key has not been depressed, the event signal $EV_2$ is derived from the multiplexer circuit 2 to erase the content of the address of the shift register 75 in which the abovesaid code is stored. When the key is held in its depressed state, the event signal $EV_2$ is not produced.

The key ON cycle and the key OFF cycle are alternate with each other. The number of addresses of the shift register 75 is limited by the number of priority channels used (not shown). If codes are stored at all addresses of the shift register 75, a newly depressed key need not be searched, so that only the key OFF cycle is repeated. In this way, the shift register 75 circulates to output in both of the key ON cycle and key OFF cycle.

Since the keyboard 1 and the multiplexer circuit 2 in FIG. 7 are identical in construction with those shown in FIG. 2, no detailed description will be repeated.

Figure 8:
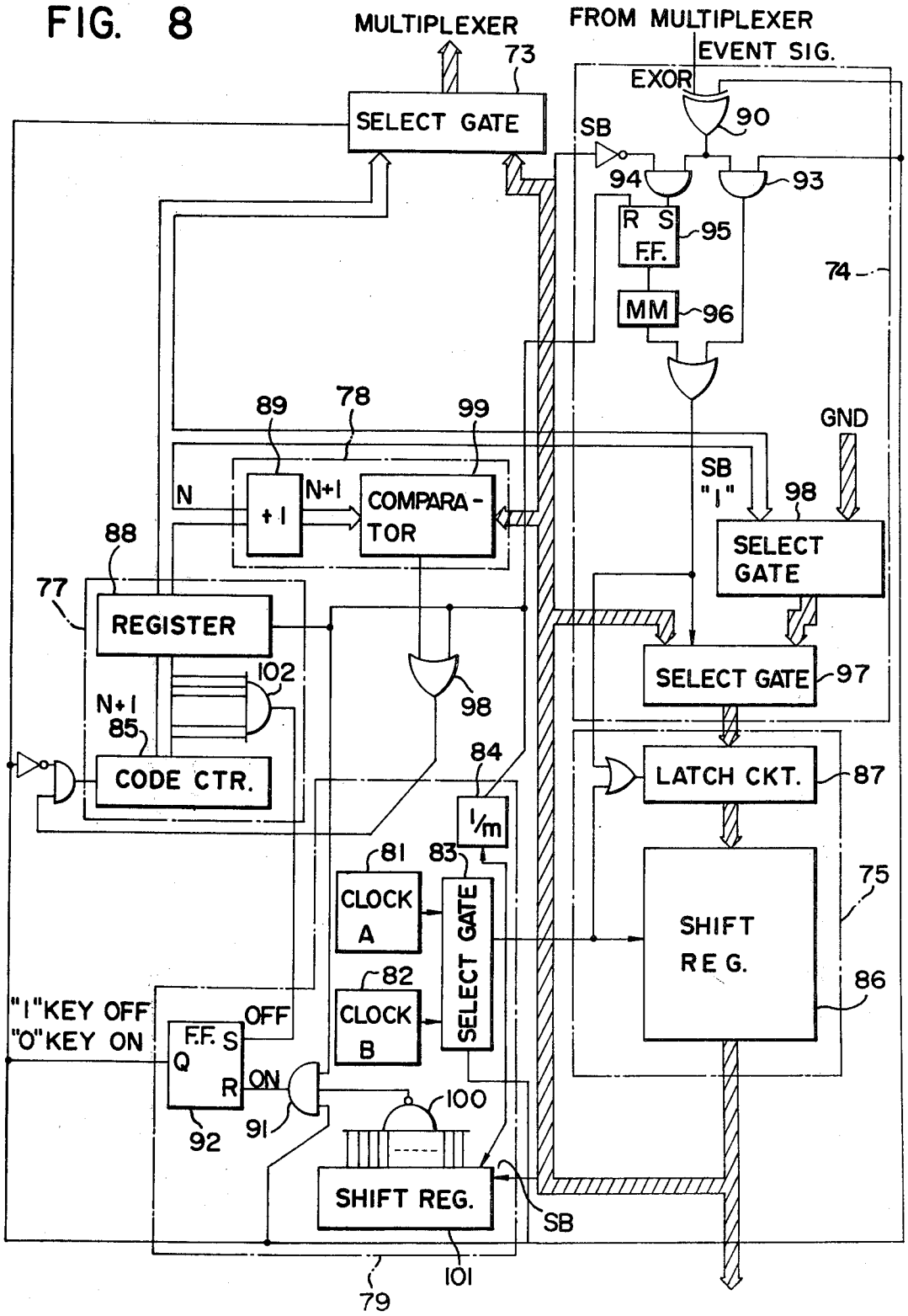
FIG. 8 shows in detail principal parts relating to the key ON cycle and the key OFF cycle in the embodiment of FIG. 7.

FIG. 8 shows in detail the principal parts relating to the key ON cycle and the key OFF cycle in FIG. 7. In FIG. 8, the parts corresponding to those in FIG. 7 are identified by the same reference numerals and the code generator circuit 77, the comparator circuit 78, the cycle control circuit 79, the select circuit 74 and the shift register 75 are respectively surrounded by broken lines and shown in detail, along with the select gate 73. FIG. 9 is a timing chart explanatory of the operation of this example.

In the key ON cycle, a clock pulse, which is generated by a clock generator A81 in the cycle control circuit 79 surrounded by the broken line in FIG. 8, is applied through a select gate 83 to a shift register (proper) 86 and a latch circuit 87 in the shift register 75 surrounded by the broken line. The code data in the shift register (proper) 86 is circulated by the abovesaid clock pulse A.

Further, the clock pulse A is frequently divided by a 1/m frequency divider 84, whose frequency-divided output is applied through an OR circuit 98 to a code counter 85 in the code generator 77 surrounded by the broken line. The code derived from the code counter corresponds to each key of the keyboard, and is supplied to the select gate 73 through a register 88. Where the key corresponding to the code supplied from the select gate 73 to the multiplexer circuit 2 is already depressed, an event signal "1" is produced. Moreover, since a flip-flop 92 in the cycle control circuit 79 provides a signal of the level "0" in the key ON cycle, this output signal and the abovesaid event signal are respectively supplied to AND circuits 93 and 94 through an exclusive OR circuit 90 in the select circuit 74. In the shift register 86, each word is composed of seven bits; one sign bit and six code bits. The sign bit indicates that codes are written in respective addresses, and is written as a signal of the level "1" when data are written. Accordingly, the sign bit takes the form of a signal of the level "0" in the case of an output from an idle address of the shift register.

When the sign bit is "0," the exclusive OR circuit 90 provides a signal "1" to open an AND gate 94, setting a flip-flop (FF) 95. Upon setting of the flip-flop (FF) 95, a monostable multivibrator (MM) 96 produces a pulse. The timing charts of the operations of the exclusive OR circuit 90 to the monostable multivibrator (MM) 96 are shown in FIGS. 9A to 9F. Shown in FIG. 9B is a clock pulse which is 1/m of the clock pulse of FIG. 9A. If the key corresponding to the code applied from the select gate 73 to the multiplexer circuit 2 is already depressed, an event signal of FIG. 9D is generated. And if the sign bit (S.B) of the output derived from the shift register 86 is such as shown in FIG. 9C, the flip-flop (FF) 95 and the monostable multivibrator (MM) 96 produce such outputs as depicted in FIGS. 9E and 9F, respectively.

The code of the sign bit "1" which is applied from the register 88 to a select gate 98 is selectively outputted by the pulse emanating from the monostable multivibrator 96, and written in the latch circuit 87. The shift register (proper) 86 comprises (m − 1) words and forms a circulation loop of m words together with the latch circuit 87. m is indicative of the number of priority channels. The content of the register 88 is branched, and applied to +1 adder 89 of the comparator 78 to be added with +1, and the added output code and the code from the shift register 86 are compared with each other in a comparator 99. In this case, if the code supplied from the register 88 to the multiplexer circuit 2 through the select gate 73 is taken as N, the next code N+1 is derived from the +1 adder 89. In the case of the key being depressed, the code is written in the shift register and it is unnecessary to detect depression of the key in the key ON cycle. Accordingly, if the code N+1 and the code from the shift register are coincident with each other, a coincidence pulse counts up the code counter 85 by one to derive therefrom a code N+2 and, by the 1/m clock pulse, the register 88 writes therein the code N+2 to obtain a code N+3 from the +1 adder 89. Thus, the register 88 shifts from N to N+2, and does not output the code N+1. That is, scanning by the multiplexer circuit for the code N+1 is left out. In this manner, the above operation is achieved for all the codes. Since the last code is "111101," the code counter 85 counts up to "111110." And when the output from the code counter 85 has becomes "111111," an AND gate 102 provides a signal "1" to set a cycle control flip-flop, shifting the key ON cycle to the key OFF cycle.

In the key OFF cycle, based on the reversal of the cycle control flip-flop 92, the select gate 83 selects a clock pulse B for the key OFF cycle. With the clock pulse B, the code data of the shift register (proper) 86 and the latch circuit 87 circulate. The output from the shift register (proper) 86 is fed through the select gate 73 to the multiplexer circuit 2 to check for a depressed key. If the key is not depressed, an event signal of the level "0" is produced to derive a signal "1" from the exclusive OR gate 90. This signal is applied to the select gate 97 through the AND gate 93. On the other hand, the select gate 98 selects and applies a ground signal GND, to the select gate 97 in the key OFF cycle. Therefore, this signal selects and writes all the bits "0" in the latch circuit 87. Where the key is continuously retained in its depressed position, no event signal is produced. Upon completion of the abovesaid operation effected for all of the addresses, the 1/m clock pulse is fed through an AND gate 91 to a flip-flop 92 to reset it, thus switching the key OFF cycle to the key ON cycle.

The output from the shift register (proper) 86 is applied to an m-bit shift register 101. The both shift registers are shifted by the same clock pulse. Accordingly, when m addresses of the shift register (proper) 86 have written therein codes, all the sign bits become "1." At this time, all the outputs from the shift register 101 become "1" and a NAND circuit 100 produces a signal of the level "0." As a result of this, the AND gate 91 is closed, so that the flip-flop is not reset by the 1/m clock pulse and the key OFF cycle is repeated again. That is, the signal of the level "0" from the NAND circuit 100 implies that all the channels are busy, and effects repetition of the key OFF cycle only.

As has been described in the foregoing, according to this invention, the operation is divided into the key ON cycle for detecting that a key is newly depressed and the key OFF cycle for detecting that a key already depressed is released, and the code for the depressed key is outputted by the time-division scanning of the m priority channels. This enables depression of the keys to be checked with a relatively simple construction as compared with the prior art which requires a complicated construction and control for distinguishing between depression and release of keys, and the code for the depressed key can be outputted by the time-division scanning of the m priority channels.

It will be apparent that many modifications and variations may be effected without departing from the scope of novel concepts of this invention.

What is claimed is:

1. Keyboard apparatus for an electronic musical instrument comprising:

a keyboard of the electronic musical instrument, keys of the keyboard being each assigned a particular code;

a multiplexer circuit for detecting the depression of the key corresponding to an input code and providing an output signal indicative of such depression;

means for sequentially generating codes of the keys;

memory means responsive to the output signal from said multiplexer circuit for storing the codes;

a cycle control circuit for controlling a key ON cycle and a key OFF cycle in distinction from each other;

a comparator circuit operative only during the key ON cycle for comparing the output from the memory means with the output from the code generating means to generate a coincidence signal only when the both outputs are coincident with each other; and gate means operative in the key ON cycle and responsive to the absence of said coincidence signal for selecting the output code from the code generating means and applying it as the input code to said multiplexer circuit, and operative in the key OFF cycle for selecting the codes stored in said memory means and applying it as the input code to said multiplexer circuit.

2. Keyboard apparatus according to claim 1, wherein, in the key ON cycle, the multiplexer circuit detects depression of the key not having been depressed and stores it in previously the memory means, and wherein, in the key OFF cycle, the multiplexer circuit detects releasing of the key from its depressed position and erases the content of the memory means.

3. Keyboard apparatus for an electronic musical instrument in which keys of the keyboard are each assigned a parcicular code, the keyboard apparatus comprising:

a multiplexer circuit for detecting depression of the key corresponding to an input code and providing an output signal indicative of such depression;

a code generator circuit for sequentially generating the codes of the keys;

a shift register responsive to the output signal from said multiplexer circuit for storing the codes;

a cycle control circuit for controlling a key ON cycle and a key OFF cycle in distinction from each other;

a comparator circuit operative only during the key ON cycle for comparing the output code from the shift register with the output code from the code generator circuit to provide a coincidence signal in the case of coincidence of the both output codes;

a select gate operative in the key ON cycle and responsive to the absence of said coincidence signal for selecting the output code of the code generator circuit and applying it as the input code to said multiplexer circuit, and operative in the key OFF cycle for selecting the codes stored in said shift register and applying it as the input code to said multiplexer circuit; and a select circuit connected with the input of the shift register to form therewith a memory loop for selecting the input code to the shift register corresponding to a control signal of the cycle control circuit.

4. Keyboard apparatus according to claim 3, wherein, in the key ON cycle, the multiplexer circuit detects depression of the key not having been previously depressed yet and stores it in the memory means, and wherein, in the key OFF cycle, the multiplexer circuit detects releasing of the key from its depressed position and erases the content of the memory means.

5. Keyboard apparatus according to claim 1, wherein said memory means comprises a plurality of memory registers and said comparator circuit comprises a corresponding plurality of comparators, each comparator respectively associated with a corresponding one of the memory registers, and wherein the codes from said code generating means are simultaneously applied to all the comparators to determine coincidence with any one of the memory registers.

6. Keyboard apparatus according to claim 1, wherein said means comprises a plurality of memory registers, and further comprising a register counter operative in the key OFF cycle for sequentially selecting each of said memory registers whereby the respective codes stored in each of said memory registers are sequentially applied to said gate means.

7. Keyboard apparatus according to claim 1 and further comprising clock means having a first and second output, in said key ON cycle, said clock is responsive to both a coincidence signal and the completion of the storage of a code in said memory means to provide a first output, and responsive to the lack of a coincidence signal to produce a second output, and in said key OFF cycle said clock is responsive to the presence of a code stored in the memory means to produce a second output and responsive to the lack of a code stored in the memory means to produce a first output, and wherein said gate means is activated by said second output, and said code generator means is activated by said first output.

8. Keyboard apparatus according to claim 3 wherein said shift register is a recirculating shift register having a plurality of words, and further comprising clock means for shifting through said shift register for each code generated by said code generator circuit to thereby compare all the words in the shift register with a code generated by said generator circuit.

9. Keyboard apparatus according to claim 3 and further comprising means operative during the key ON cycle for detecting when said shift register is full and thereupon automatically shifting to said key OFF cycle.

* * * * *